US005165213A

United States Patent [19]

Finch et al.

[11] Patent Number: 5,165,213

[45] Date of Patent: Nov. 24, 1992

[54] PARTITION WALL AND INTERLOCKING PANELS THEREFOR

[76] Inventors: Harry F. Finch, 5273 Vista del Sol, Cypress, Calif. 90630; Geza J. Szayer, 24771 Acropolis Dr., Mission Viejo, Calif. 92691

[21] Appl. No.: 683,794

[22] Filed: Apr. 11, 1991

Related U.S. Application Data

[63] Continuation of Ser. No. 585,905, Sep. 21, 1990, abandoned, which is a continuation of Ser. No. 104,249, Oct. 5, 1987, abandoned.

[51] Int. Cl.[5] ..... E04B 2/00

[52] U.S. Cl. ..... 52/588; 52/578; 52/589; 52/520; 52/536

[58] Field of Search ..... 52/578, 588, 589, 547, 52/546, 519, 520, 525, 526, 527, 478, 422, 536

[56] References Cited

U.S. PATENT DOCUMENTS

| | | | |
|---|---|---|---|
| Re. 28,987 | 10/1976 | Iacona | 52/588 |
| 417,946 | 12/1889 | Sagendorf | 52/520 |
| 1,693,274 | 11/1928 | Hayman | 52/520 |
| 2,765,887 | 10/1956 | Horowitz | 52/520 |
| 3,055,460 | 9/1962 | Maroney | 52/582 |
| 3,128,851 | 4/1964 | De Ridder et al. | 52/588 |
| 3,191,724 | 6/1965 | De Ridder | 52/588 |
| 3,402,526 | 9/1968 | Baxter | 52/520 |
| 3,512,222 | 5/1970 | Tinnerman | 52/520 |
| 3,524,292 | 8/1970 | Bottom | 52/588 |
| 3,906,696 | 9/1975 | Poter et al. | 52/536 |
| 4,063,393 | 12/1977 | Toti | 52/522 |
| 4,106,250 | 8/1978 | Cummings et al. | 52/531 |
| 4,125,340 | 11/1978 | Klaus et al. | 52/588 |
| 4,546,590 | 10/1985 | Finch et al. | 52/520 |
| 4,557,086 | 12/1985 | Liefer et al. | 52/194 |

FOREIGN PATENT DOCUMENTS

| | | | |
|---|---|---|---|
| 219830 | 2/1962 | Austria | 52/519 |

*Primary Examiner*—David A. Scherbel
*Assistant Examiner*—Robert Canfield
*Attorney, Agent, or Firm*—Henry M. Bissell

[57] ABSTRACT

An inexpensive modular partition wall is provided by panels which include a substantially planar, rectangular central part bordered on opposite sides by substantially planar, rectangular side parts having connector members on opposed sides and integral therewith. Each connector member is generally V-shaped with one arm truncated so as to fit under a line of locking tabs on a like connector member into which it is inserted. Two connectors can be joined together hermaphroditically in the sense that a first connector can be inserted into a second connector or the second connector can be inserted into the first to give the same effect. Panels connected to one another to form a wall can persist or alternate in the gender of their connectedness. Construction of a wall proceeds extremely rapidly, since there are no screw-fastening steps to make. Top and bottom channel members may be employed to increase the rigidity of the wall.

10 Claims, 2 Drawing Sheets

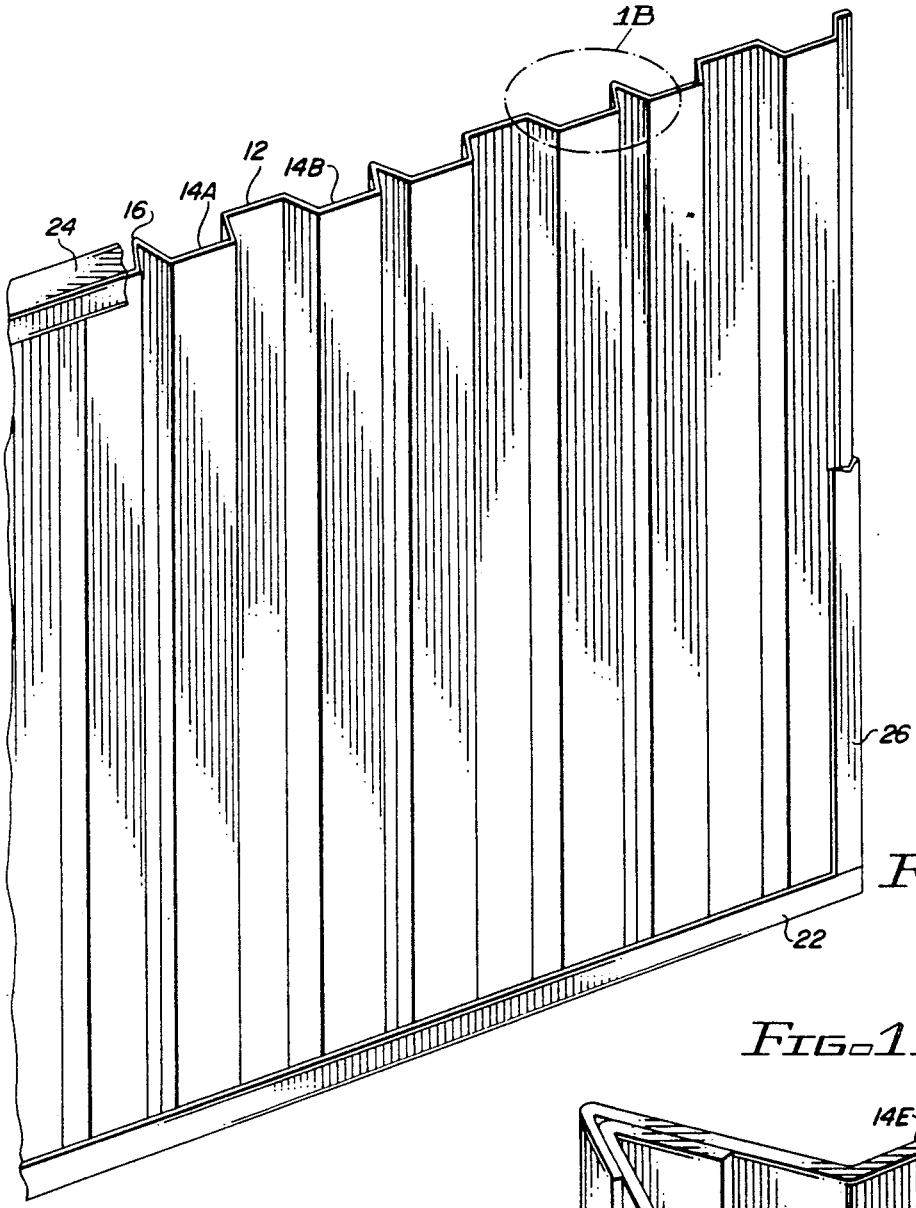
FIG. 1A
FIG. 1B
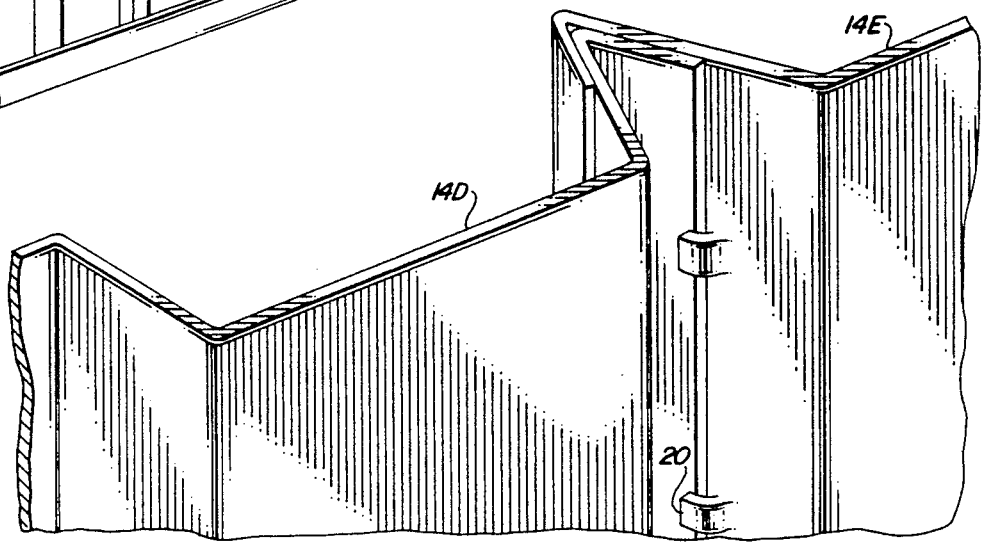

PARTITION WALL AND INTERLOCKING PANELS THEREFOR

This is a continuation, of application Ser. No. 07/585,905 filed Sep. 21, 1990, which is a continuation of Ser. No. 07/104,249, filed Oct. 5, 1987 now abandoned.

BACKGROUND OF THE INVENTION

1. Field of the Invention.

This invention relates to modular partition panels and, more particularly, to modular panels made from metal or plastic sheets having opposed end portions formed into V-shaped connector members which can interlock with connector members of adjacent panels.

2. Description of the Related Art.

Partition walls that can be assembled and disassembled quickly and easily are useful in providing storage areas of varying sizes to meet the changing demands for space in self service warehouses. Each customer requires a storage unit of a particular size to meet his or her individual requirements. Modular construction using standard size panels is a convenient way of meeting customer requirements. As requirements change, old storage units can be easily disassembled and new ones quickly erected to satisfy the new requirements. Such storage units should be inexpensive, durable, strong, and easy to connect together or disconnect.

U.S. Pat. No. 4,546,590 to Finch and Szayer discloses a modular partition system based on panels which are generally rectangular and have connector members on opposed sides of a central body. Each connector member includes female and male members joined by a stop element which is generally perpendicular to the body. The panels may be connected to one another to form a wall by either an abutting type or overlapping type connection. In the abutting type connection, one connector member of one panel interlocks with a connector member of the other panel and the female and male elements come into mating engagement with each other. with the stop elements of each member abutting each other. In the overlapping type connection, the ends of adjacent panels overlap each other and the male elements of each connector member are secured to the body of an opposing panel. Not only may two panels be joined together, but three or four panels may be interconnected to form a common junction. The mating configuration of the connecting end portions advantageously permits joining of adjacent panels with varying degrees of overlap corresponding to the space in which the panels are to be mounted, thus eliminating the need to cut a panel to fit a limited space.

Although the modular partition system described in U.S. Pat. No. 4,546,590 can be assembled or disassembled relatively rapidly, it does require the use of sheet metal screws or similar fastening elements to secure the panels together.

The modular construction system of U.S. Pat. No. 3,055,460 to Maroney makes use of a construction panel which can be connected to a load-bearing frame member or used as a non-load-bearing construction panel which can be mounted on the load-bearing construction panel. The system described requires the bolting together of adjacent panels.

U.S. Pat. No. 3,128,851 to Derrider et al. relates to metallic structural members adapted to be formed by extrusion and having ends so formed that a plurality of the said members may be interlocked. The metallic structural member described is particularly adapted for use as flooring in vehicles such as trucks, railway cars, and so forth. For this reason the structural member is provided with a hole through which a bolt can pass for attachment of the member to an underlying structure.

SUMMARY OF THE INVENTION

The present invention provides an inexpensive, modular, quick-connect partition system of panels that are strong, durable, and easy to connect together or disassemble, and that provide a wide range of storage unit sizes. Panels are ordered from the factory to meet the height specifications for any given installation. The panels are formed in accordance with the invention to provide interlocking edge connectors which can be joined in a matter of seconds. No special training is necessary to install or disassemble the panels. The storage units made from these panels are both safe and secure.

The panels are preferably made from metal sheets such as of galvanized steel. Corrugated ribs in the sheets can be employed to strengthen the panel. Each panel is composed of three contiguous flat horizontal parts, a central part and two side parts. The free ends of the two side parts are formed into unique V-shaped connector members having a row of locking tabs inside the V. The outer arm of the V is shortened so that when one V-arm connector member is inserted into another, the shortened end of one snaps into place underneath the locking tabs on the longer V-arm connector of the other. The connector member has both male and female characteristics but only one type is used in a particular connection. Thus, a connection can be made by inserting a first connector member into a second, or by inserting the second into the first. In a partition wall made from a series of panels, the panel alternates in the maleness or femaleness of their connector members.

One advantage of the present invention is that no screws or bolts or other fastening means are needed to connect the panels together. Horizontal channel members can be used to reinforce and stabilize the panels joined together in a panel wall. Other advantages of the present invention are that the panels are readily manufactured and provide a versatile and convenient system for making partition walls of different sizes which are secure, strong, and inexpensive to purchase, install, and disassemble.

BRIEF DESCRIPTION OF THE DRAWINGS

A better understanding of the present invention may be gained from a consideration of the following detailed description, taken in conjunction with the accompanying drawing in which:

FIG. 1A is a perspective view of a part of a partition wall made according to the present invention;

FIG. 1B is a detailed enlargement of the circled area in FIG. 1A;

DESCRIPTION OF THE PREFERRED EMBODIMENTS

Figure 2A:
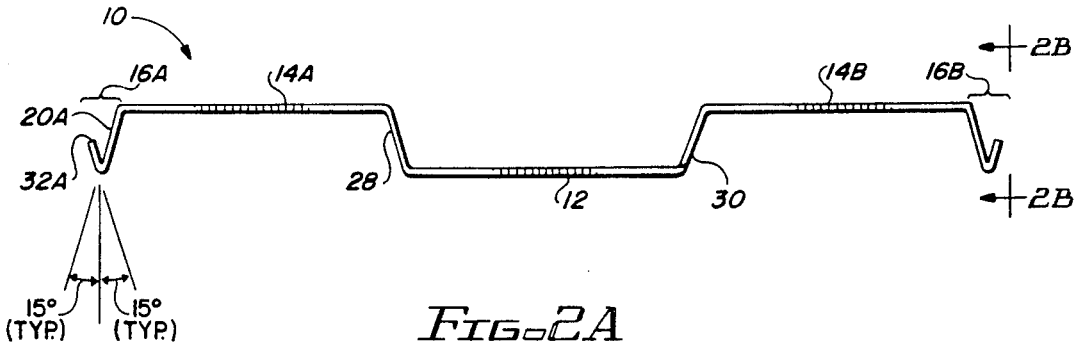
FIG. 2A is an end view of one of the panels making up the wall in FIG. 1A.

FIG. 1 shows several panels 10 of this invention connected together to form part of a partition wall. These panels 10, referred to as standard panels 10, have an effective nominal width of nineteen inches. Each panel is composed of a central part 12 flanked on either side by side parts 14A and 14B. The central part 12 is laterally offset from the plane of the two side parts 14A and 14B by two substantially right-angle bends, and the three parts comprising a panel 10 are of equal width.

A unique type of connector member 16 making up the side edge of each panel 10 in the wall joins adjacent panels together as shown in FIG. 1B, which shows the circled part of FIG. 1A in more detail. The connector member 16 is substantially V-shaped with the distal arm of the V being shorter than the proximal arm of the V. When the vertex of one such connector member 16 is inserted into the V-shaped channel of another such connector member 16, the distal V-arm 32 of the inserted connector member snaps into place beneath a series of locking tabs 20 spaced at intervals along a vertical line in the middle of the proximal V-arm of the receiving connector member. The locking tabs 20 are partially punched out of the sheet metal material of the panel 10 so that they present openings facing the vertex in the interior of the V-shaped connector member 16. The flexibility of the material from which the panels 10 are made is sufficient to allow the connector member 16 of one panel to be inserted into interlocked engagement with the connector member 16 of another panel 10.

The nominal spacing between locking tabs 20 is about six inches, and the general shape of a tab 20 can be either rectangular (as shown) or semicircular. The width of a locking tab 20 is typically about half an inch for a panel nineteen inches wide.

Referring again to FIG. 1A, bottom channel members 22 and top channel members 24 can be utilized to make the partition wall more rigid as well as give a more finished and pleasing look to the wall. An end channel member 26 is used to finish off the side end of a wall.

FIG. 2A is an end view of a panel 10. The central part 12 of the panel 10 is flat and substantially rectangular, with identical side parts 14A and 14B parallel to the central part and displaced from it by bent transition segments 28 and 30. Opposing ends of the panel 10 have identical connector elements 16A and 16B which are oriented so that one is the mirror image of the other. Each connector member 16 is substantially V-shaped, with a dihedral angle of typically about thirty degrees. The locking tabs 20 are distributed along the midline of the longer arm of the V of the connector member 16. The shorter arm of the V of the connector member 16 has a length chosen so that when one connector member 16 is inserted into another connector member 16, the free edge 32 of the shorter V-arm of the connector member 16 is caught beneath the locking tabs 20.

Figure 2B:
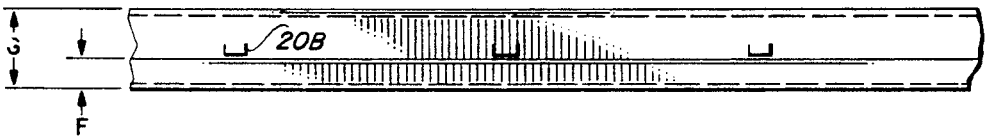
FIG. 2B is a view of the panel along line A—A of FIG. 2A.

FIG. 2B is a view along the line A—A in FIG. 2A. The dimensions marked F and G in FIG. 2B have nominal values of 0.62 inch and 1.37 inches for the dihedral angle of 30 degrees mentioned above.

In a preferred embodiment, the material of which the panel 10 is made is light-gauge galvanized steel. For some applications in which light weight is a desired property, the panel 10 could be made of a plastic material.

Figure 3A:
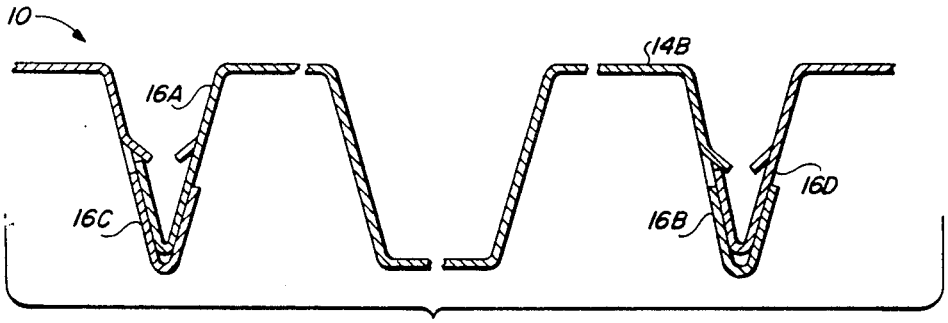
FIG. 3A is a compressed end view of a panel with its connector members interlocked with those of adjacent panels.

FIG. 3A is a foreshortened end view of a panel 10 connected to adjacent panels by insertion of its connector member 16A into connector member 16C of one adjacent panel, and insertion of connector member 16D of the other adjacent panel into connector member 16B. In constructing a partition, the (say) leftmost connector member of each successive panel is inserted into the rightmost connector member of the previous panel, or vice versa.

Figure 3B:
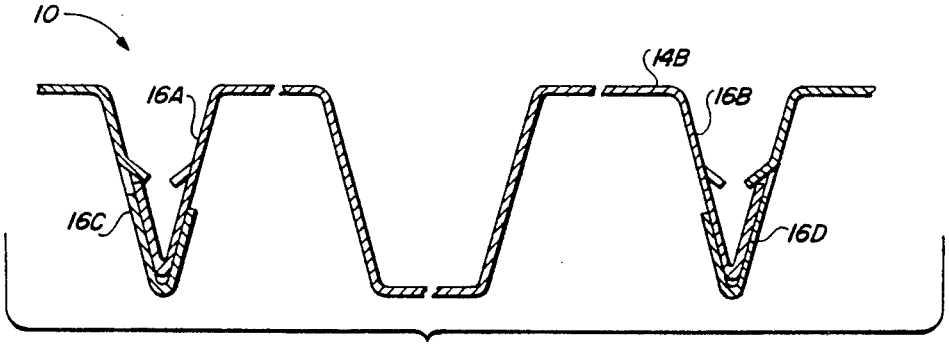
FIG. 3B is a compressed end view of an alternative way of connecting three adjacent panels.

FIG. 3B is a foreshortened end view of a panel 10 connected to adjacent panels by the alternative method of inserting its connector members 16A and 16B into the connector members 16C and 16D of the adjacent panels. In this way of constructing a partition, the connector members 16A and 16B of a given panel 10 are either both inserted into the connectors of adjacent panels, or both connector members are inserted into by the connector members of adjacent panels. One reason for using this method is that the two side parts next to a pair of interlocking connector members are laterally displaced from each other in one direction or the other, depending on which connector member is inserted into which. If a rule of keeping connector members on a given panel both male or both female is adhered to, there is no net lateral displacement from one end of the wall to the other.

Although there has been described above a specific arrangement of modular panels having novel connector members in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. A first panel for assembly with other like panels to form a partition wall, said panel comprising:

a plurality of vertically oriented portions integrally formed from a single sheet of material in a configuration of adjacent laterally offset portions in respective first and second parallel planes;

said formed sheet having terminal top, bottom and side edges, respectively, the vertically oriented portions of said panel adjacent the side edges of the panel being juxtaposed in line with said first plane of the panel;

both side edges of the panel having V-shaped edge connectors extending from adjacent vertical portions at nearly right angles in a direction away from said first plane, each edge connector having a first arm of the V-shape joined to said adjacent vertical portion and a second arm of the V-shape remote from said vertical portion, said second arm having a lateral dimension which is equal to less than half the lateral dimension of the first arm, and a plurality of vertically spaced, in-line locking tabs integrally formed by punching openings in the first arm to define said locking tabs protruding from the plane of said first arm, said in-line locking tabs being positioned along said first arm to engage the peripheral edge of the second arm of an adjacent panel when connected together with said first panel;

such that the nesting together of the edge connectors of a pair of adjacent panels releasably latches the two together by the second arm of one panel edge connector being latched between the locking tabs and apex of the V-shape of the other panel edge connector.

2. The panel of claim 1 wherein said vertically oriented segments include horizontally directed reinforcing ribs.

3. The panel of claim 1 wherein the angle between the first and second arms of the V-shaped edge connectors is approximately 30 degrees.

4. The panel of claim 1 wherein said single sheet of material comprises a generally rectangular metal sheet having a thickness ranging between about 0.016 inch and about 0.030 inch, said rectangular sheet being bounded by longitudinal edges which are generally parallel to each other and to the centerline of the sheet material.

5. The panel of claim 1 wherein each of the vertically oriented portions juxtaposed along the respective parallel planes of the panel is aproximately 6 inches wide and the spacing between the planes is approximately 1.37 inches.

6. A partition wall comprising a plurality of substantially identical panels, each panel comprising:

a plurality of vertically oriented portions integrally formed from a single sheet of material in a configuration of adjacent laterally offset portions in respective first and second parallel planes of the panel;

said formed sheet having terminal top, bottom and side edges, respectively, the vertically oriented portions of said panel adjacent the side edges of the panel being juxtaposed in line with said first plane of the panel;

both side edges of the panel having V-shaped edge connectors extending from adjacent vertical portions at nearly right angles in a direction way from said first plane, each edge connector having a first arm of the V-shape joined to said adjacent vertical porition and a second arm of the V-shape remote from said vertical portion, said second arm having a lateral dimension which is equal to less than half of the lateral dimension of the first arm, and a plurality of vertically spaced, in-line locking tabs integrally formed by punching opening in the first arm to define said locking tabs protruding from the plane of said first arm, said in-line locking tabs being positioned along said first arm to engage the peripheral edge of the second arm of an adjacent panel when connected together with siad first panel;

such that the nesting together of the edge connectors of a pair of adjacent panels releasably latches the two together by the second arm of one panel edge connector being latched between the locking tabs and apex of the V-shape of the adjacent panel edge connector.

7. The partition wall of claim 6 wherein the vertically oriented portions of each panel include horizontally directed reinforcing ribs.

8. The partition wall of claim 6 wherein the single sheet of material in each panel comprises a rectangular metal sheet having a thickness ranging between about 0.016 inch and about 0.030 inch, said rectangular sheet being bounded by longitudinal edges which are generally parallel to each other and to the centerline of the sheet material.

9. The partition wall of claim 6 further comprising a plurality of channel members extending along the top and bottom edges of said panels for reinforcing the panels joined together in the partition wall.

10. The partition wall of claim 6 wherein each panel edge connector has both male and female characteristics, such that a pair of adjacent panels may be latched together by inserting an adjacent edge connector of either panel into the edge connector of the other panel of said pair.

* * * * *